US006722326B1

(12) United States Patent
Shui et al.

(10) Patent No.: US 6,722,326 B1
(45) Date of Patent: Apr. 20, 2004

(54) VARIABLE LIFT CYLINDER VALVE SYSTEM FOR INTERNAL COMBUSTION ENGINE

(75) Inventors: Fang Shui, Farmington Hills, MI (US); John Edmund Brune, Stockbridge, MI (US); Mark Alan Zagata, Livonia, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 10/065,403

(22) Filed: Oct. 14, 2002

(51) Int. Cl.[7] ..... F01L 1/34

(52) U.S. Cl. ..... 123/90.16; 123/90.39; 123/90.44

(58) Field of Search ..... 123/90.16, 90.39, 123/90.4, 90.41, 90.44, 90.48, 90.6, 188.1, 188.2; 74/559, 567, 569, 469, 471; 29/888.2

(56) References Cited

U.S. PATENT DOCUMENTS

| | | | | |
|---|---|---|---|---|
| 4,898,130 A | | 2/1990 | Parsons | |
| 4,986,227 A | | 1/1991 | Dewey, III | |
| 5,280,776 A | | 1/1994 | Dick | |
| 5,732,669 A | * | 3/1998 | Fischer et al. | 123/90.16 |
| 5,809,951 A | | 9/1998 | Kim | |
| 6,568,361 B2 | * | 5/2003 | Hara et al. | 123/90.29 |
| 6,615,782 B1 | * | 9/2003 | Hendriksma et al. | 123/90.39 |

* cited by examiner

*Primary Examiner*—Thomas Denion
*Assistant Examiner*—Ching Chang

(57) ABSTRACT

A variable lift cylinder valve system for an internal combustion engine includes a poppet valve operated by a rocker arm which is articulated about a translational pivot having its placement determined by a control shaft which operates a control arm in contact with the translational pivot such that rotation of the control shaft produces translational motion of the pivot so as to control the lift ratio of the rocker arm.

8 Claims, 2 Drawing Sheets

VARIABLE LIFT CYLINDER VALVE SYSTEM FOR INTERNAL COMBUSTION ENGINE

BACKGROUND OF INVENTION

1. Field of the Invention

The present invention relates to a system for providing infinitely variable valve lift for power cylinder poppet valves in a reciprocating internal combustion engine.

2. Disclosure Information

Designers of reciprocating internal combustion engines have sought to employ variable valve lift systems. Such systems have been largely driven by a desire to achieve better fuel economy and driveability in the face of increasingly stringent emission and fuel economy requirements. Not surprisingly, several variable lift mechanisms have been proposed by various designers. These proposed designs range from extremely complicated mechanical systems such as that shown in SAE Technical Paper 2000-01-1221, to more straightforward systems such as that shown in SAE Technical Paper 970334. The system shown in SAE 970334 includes a hollow rocker arm having a geared rack and movable pinion shaft which translates so as to cause adjustment of the rocker arm lift ratio. Unfortunately, such a system would suffer from packaging problems because the volume of the system is too great. And the functionality of the system presents issues insofar as it is necessary to use a geared interface between the rocker arm and the geared movable pinion shaft.

The present system offers valve lift control with a straightforward design, good packageability and excellent function.

SUMMARY OF INVENTION

A variable lift cylinder valve system for internal combustion engine includes at least one poppet valve disposed within a cylinder head of an engine, with the poppet valve having a head and a stem adapted for contact by a valve opening member. A spring biases the poppet valve into a closed position. At least one valve operating camshaft is mounted in the engine. The camshaft carries at least one cam lobe. A rocker arm is in contact with both the cam lobe and the valve stem. A translational pivot which is in contact with the rocker arm converts a linear component of motion of the cam lobe into rotational motion of the rocker arm and corresponding linear motion of the poppet valve. A control shaft extending along an axis generally parallel to the axis of the camshaft is mounted for pure rotation about the control shaft axis. A control arm mounted upon the control shaft and operatively connected with the translational pivot converts the rotational motion of the control shaft into translational motion of the pivot so as to control the lift ratio of the rocker arm. In this manner, the lift of the valve is infinitely controllable between a condition of no lift at all i.e. the closed position, and full lift. In essence, the system uses a range of composite positions in which the camshaft, cam lobe, rocker arm, and control arm are configured so as to cause valve lift to range from no lift at all to maximum lift.

In order to achieve proper control of the valves according to a system of the present invention, the control arm and control shaft cannot rotate independently. This fact provides an opportunity to accurately calibrate the minimum lift position of the variable lift cylinder valve system claimed herein. In essence, during calibration, the camshaft is placed in a predetermined rotational position, whereas the cylinder valve being calibrated is placed in a predetermined position vis-à-vis the valve seat. Then, the control arm is locked to the control shaft in the position which the rocker arm assumes as a result of the predetermined camshaft and cylinder valve positions.

It is an advantage of the present invention that notwithstanding its variable valve lift capability, a system and method according to this invention uses a conventional camshaft which provides a reliable means for actuating valves in an engine.

It is a further advantage that the present system is readily retrofittable into existing engine designs. This obviates the need for extensive retooling of cylinder heads.

It is a further advantage that the system of the present invention achieves variable lift control with simple kinematics and relatively few moving parts, which reduces the cost of manufacturing and improves the accuracy of valve lift control.

It is a further advantage of the present invention that this system reduces the coefficient of variation of the indicated mean effective cylinder pressure (IMEP), particularly at idle. It is well known to those skilled in the art that variation of IMEP at idle is extremely detrimental to idle stability. Thus, it is very advantageous that the present system provides a means to accurately calibrate the valve lift, particularly lifts in the range used during engine idle.

It is a further advantage of the present invention that the present system and method are adaptable to engine control strategies having varying complexity and technical sophistication.

Other advantages, as well as features and objects of the present invention, will become apparent to the reader of this specification.

DETAILED DESCRIPTION

Figure 1:
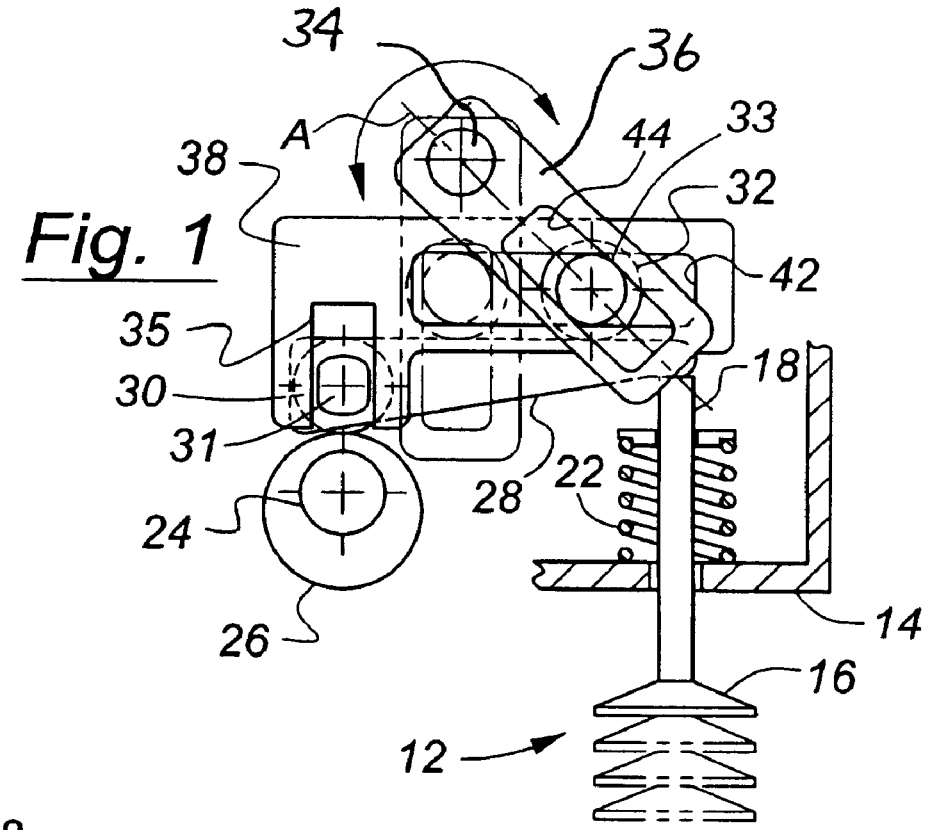
FIG. 1 is a systematic representation of a continuously variable lift cylinder valve system according to present invention.
Figure 2:
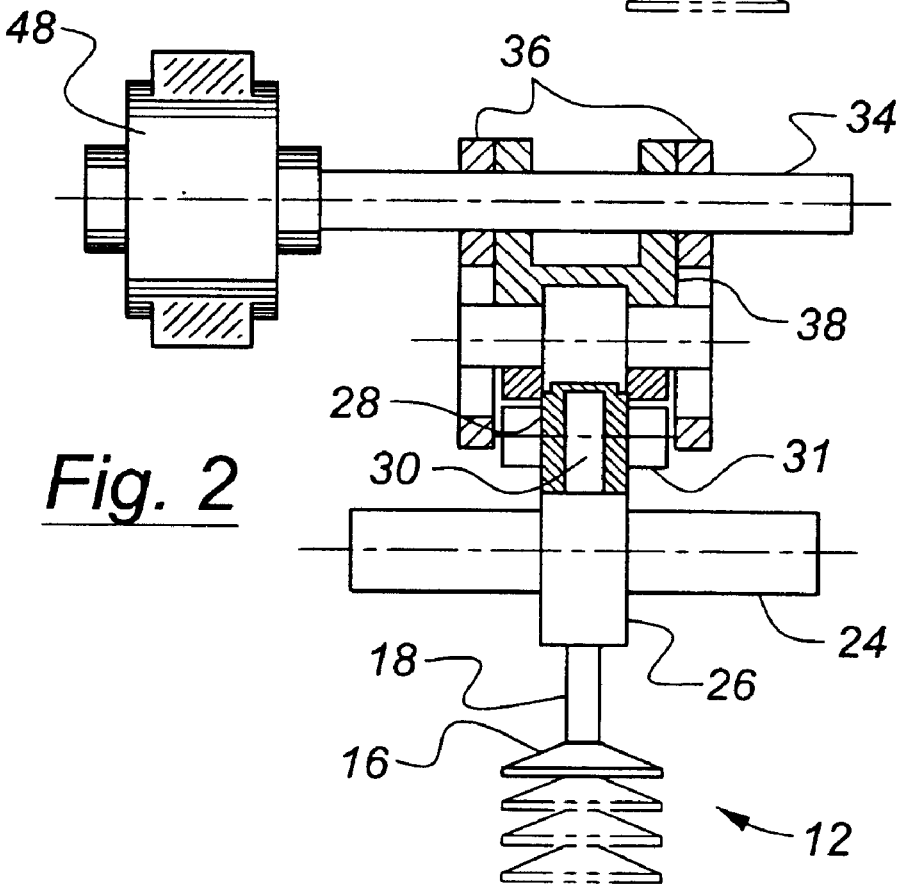
FIG. 2 is a systematic representation similar to FIG. 1 taken in the direction of arrows 2—2 of FIG. 1.

As shown in FIGS. 1 and 2, a variable lift cylinder valve system according to the present invention is intended to operate one or more poppet valves 12 which are mounted within cylinder head 14. Each of poppet valves 12 has a head 16, and a valve stem 18, and is biased into its closed position by compression spring 22. Valves 12 are operated by camshaft 24, which has a plurality of cam lobes 26 mounted thereon. Camshaft 24 may be driven in conventional fashion, with or without variable camshaft timing control. Camshaft lobe 26 is in contact with roller 30. Rocker arm 28 is also in contact with valve stem 18 as well as with transitional pivot roller 32. Transitional pivot roller 32 converts the linear (i.e., up and down) component of the motion of cam lobe 26 into rotational motion of rocker arm 28 and corresponding linear (i.e., open and close) motion of poppet valve 12.

Transitional pivot roller 32 is mounted upon roller shaft 33 which is in turn guided by slot 44 in pivot control arm 36.

Each pivot control arm 36 is mounted upon control shaft 34. Control shaft 34 extends along an axis generally parallel to the axis of camshaft 24. Control shaft 34 is mounted for pure rotation about its axis; control shaft 34 does not translate when valve lift is being controlled, or, for that matter any other time during operation of an engine having a system according to present invention. Control arm 36 is in effect an elongate member having a principal axis. A and having longitudinal slot 44 extending along a portion of principal axis A. Longitudinal slot 44 receives shaft 33 upon which transitional pivot roller 32 is mounted.

Control shaft 34 is journalled upon rocker arm carrier 38, which is itself mounted rigidly upon cylinder head 14. Rocker arm carrier 38 has a first guideway 35 which extends in a direction generally parallel to stem 18 of poppet valve 16. First guideway 35 receives guide pin 31 of roller 30. First guideway 35 thus locates rocker arm 28 so as to prevent rocker arm 28 from moving laterally in an unwanted manner. Rocker carrier 38 also has a second guideway 42 which extends in a direction generally perpendicular to valve stem 18, and which slidlingly receives roller shaft 33 of transitional pivot roller 32. In essence, roller shaft 33 comprises a guide pin of transitional pivot 32. Similarly, guide pin 31 provides a guide function for roller follower 30.

According to an alternative shown more specifically in FIG. 2, the control arm structure may comprise a bifurcated elongate member having two individual control arms 36, with each of the arms having a principal axis and a longitudinal slot extending along a portion of the principal axis, with each of the longitudinal slots receiving common shaft 33 upon which translational pivot 32 is mounted. In essence, a pair of arms 36 will be mounted on either side of rocker arm carrier 38.

Rotary actuator 48, which may comprise a cam or pulley member driven by a cable, or a stepper motor, or a gear motor, or hydraulically driven actuator, or other types of actuators known to those skilled in the art and suggested by this disclosure, serves to rotationally position control arms 36, so as to set the system to the desired valve lift. Rotary actuator 48 may be driven by either an engine controller, or by a linkage from a control such as an accelerator pedal, or by other mechanisms known to those skilled in the art and suggested by this disclosure.

Figure 3:
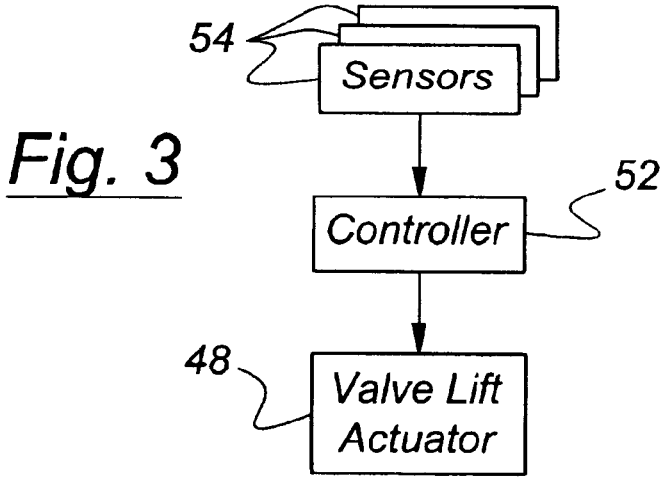
FIG. 3 is a systematic representation of a control system according to the present invention.

The overall architecture of the current system is shown in FIG. 3, wherein controller 52, which is drawn from the class of controllers known to those skilled in the art and suggested by this disclosure, receives inputs from a plurality of engine operating parameter sensors 54 which sense such variables as throttle position, engine speed, intake manifold pressure, and other parameters known to those skilled in the art and suggested by this disclosure. Controller 52 operates according to the sequence of FIG. 4 and selects a position for valve lift actuator 48, so as to thereby control the lift of poppet valve 12.

Figure 4:
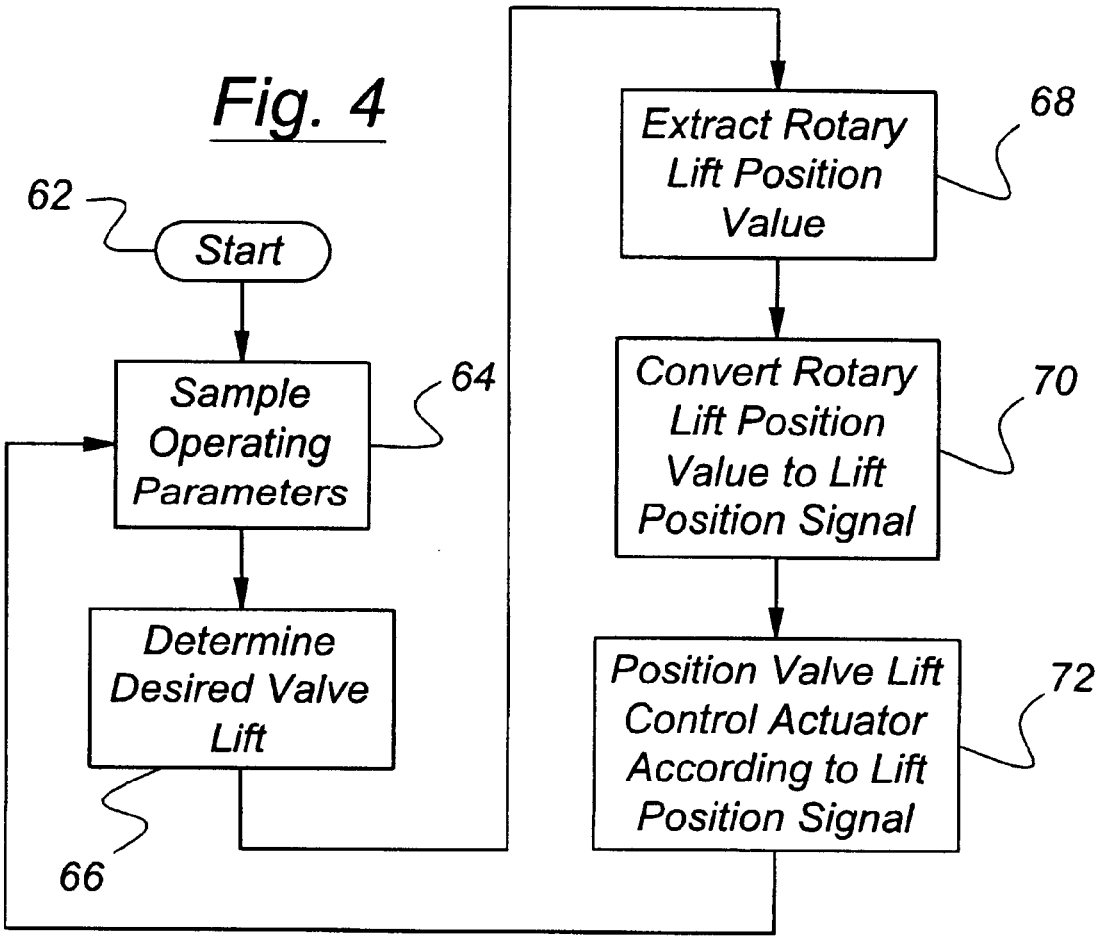
FIG. 4 is a flowchart illustrating a method for controlling a variable lift valve system according to the present invention.

Moving now to FIG. 4, a method according to the present invention begins at start block 62 and then moves to block 64 where controller 52 samples the operating parameters described above. Having sampled the parameters, controller 52 determines the desired valve lift. The desired lift may be determined according to a number of different schemes known to those skilled in the art and suggested by this disclosure. For example, lift may be minimized at idle so as to obtain desired charge motion and a low coefficient of variation of the indicated mean effective pressure. Having determined the desired valve lift at block 66, controller 52 moves to block 68 wherein a rotary lift position value is extracted from a lookup table within controller 52, by using the desired lift value as an input variable. Those skilled in the art will appreciate in view of this disclosure that other types of valve lift input variables can be used other than desired valve lift. Having determined the rotary lift position variable at block 68, controller 52 moves to block 70 wherein the rotary lift position value is converted to a lift signal which is then used at block 72 by controller 52 to position valve lift control actuator 48 to achieve the desired valve lift adjustment.

The present system and method also include a method for calibrating the minimum lift position of a variable valve lift system configured according to the present invention. According to this method, camshaft 24 is first placed so that a relevant cam lobe 26 will be in a position of maximum valve lift. At the same time, cylinder valve 12 is placed in a desired position for minimum lift. Note, the position of minimum lift is not the position in which the valve is closed, by rather a position where the valve is located only a small distance from the valve seat. This position of minimum lift is important for achieving a significant reduction in the coefficient of variation of the indicated mean effective pressure at idle and it is further important to control valve opening at the low lift levels needed at low and medium loads to achieve proper charge motion control. This in turn produces concomitant benefits in terms of emissions reduction and fuel economy improvement.

During the adjustment of the control arm, once the camshaft has been placed in a position of maximum lift and the cylinder valve has been in the predetermined minimum lift position, the control arm will be locked to the control shaft. Once this locking has occurred, the control arm will not be able to rotate with respect to the control shaft and as a result, in the position of the control shaft will correspondingly give unique positions of the control arm and unique valve lift.

Rocker arm carrier 38 may either comprise an integral part of cylinder head 14, or alternatively, a drop-in structure. In other words, rocker arm carrier 38 may comprise a separate part from cylinder head 14, with rocker arm carrier 38 being bolted in place upon cylinder head 14. An individual rocker arm carrier 38 could be employed for each valve being controlled according to the present invention Alternatively, a single rocker arm carrier 38 could be used for a pair of valves for a single cylinder. Such modifications are consigned to those wishing to employ a method and system according to the present invention. In any event, the present method and system will provide adjustable valve lift at a lower cost than known systems and will also permit adaptation of valve control such as that involved in variable displacement engines, direct injection gasoline engines, diesel engines and other engines known to those skilled in the art and as suggested by this disclosure.

Although the present invention has been described in connection with particular embodiments thereof, it is to be understood that various modifications, alterations and adaptations may be made by those skilled in the art without departing from the spirit and scope of the invention. It is intended that the invention be limited only by the appended claims.

What is claimed is:

1. A variable lift cylinder valve system for an internal combustion engine, comprising:

at least one poppet valve disposed within a cylinder head of the engine, with said poppet valve having a head and a stem adapted for contact by a valve opening member;

a spring for biasing the poppet valve into a closed position;

at least one valve operating camshaft carrying at least one cam lobe;

a rocker arm in contact with said at least one cam lobe and said valve stem;

a translational pivot, in articulated contact with the rocker arm, for converting a linear component of motion of said at least one cam lobe into rotational motion of the rocker arm and a corresponding linear motion of said poppet valve;

a control shaft extending along an axis generally parallel to the axis of said camshaft, with said control shaft being mounted for pure rotation about said control shaft axis; and a control arm, mounted upon said control shaft and operatively connected with said translational pivot, for converting rotational motion of said control shaft into translational motion of said pivot, so as to control the lift ratio of said rocker arm.

2. A cylinder valve system according to claim 1, wherein the positions of said control shaft, said control arm and said translational pivot are infinitely variable from a composite position of minimum lift of the poppet valve to a composite position of maximum lift of the poppet valve.

3. A cylinder valve system according to claim 1, wherein said control arm is mounted upon the control shaft such that the control arm cannot rotate independently of the control shaft.

4. A cylinder valve system according to claim 1, further comprising a rocker arm carrier adapted for rigid mounting to a cylinder head of an engine, with said carrier having a first guideway for a guide pin of a roller follower attached to said rocker arm, and a second guideway for a guide pin of said translational pivot.

5. A cylinder valve system according to claim 4, wherein said first guideway extends in a direction generally parallel to the stem of said poppet valve, and said second guideway extends in a direction generally perpendicular to said stem.

6. A cylinder valve system according to claim 1, wherein said control arm comprises an elongate member having a principal axis, with said control arm further having a longitudinal slot extending along a portion of said principal axis, and with said longitudinal slot receiving a shaft upon which said translational pivot is mounted.

7. A cylinder valve system according to claim 1, wherein said control arm comprises a bifurcated elongate member having a principal axis, with said control arm further having two longitudinal slots extending along a portion of said principal axis, and with each of said longitudinal slots receiving a common shaft upon which said translational pivot is mounted.

8. A cylinder valve system according to claim 1, further comprising a controller for determining a desired valve lift value from the value of at least one engine operating parameter, with said controller operating a valve lift actuator coupled to said control shaft.

* * * * *